US011677181B2

(12) United States Patent
Chen

(10) Patent No.: US 11,677,181 B2
(45) Date of Patent: Jun. 13, 2023

(54) CONNECTION TERMINAL

(71) Applicant: XIAMEN GHGM INDUSTRIAL TRADE CO., LTD, Xiamen (CN)

(72) Inventor: Bingshui Chen, Xiamen (CN)

( * ) Notice: Subject to any disclaimer, the term of this patent is extended or adjusted under 35 U.S.C. 154(b) by 0 days.

(21) Appl. No.: 17/503,717

(22) Filed: Oct. 18, 2021

(65) Prior Publication Data

US 2022/0311178 A1 Sep. 29, 2022

(30) Foreign Application Priority Data

Mar. 29, 2021 (CN) ..... 202110333539.9

(51) Int. Cl.

| | |
|---|---|
| ***H01R 13/58*** | (2006.01) |
| ***H01R 4/2407*** | (2018.01) |
| ***H01R 13/506*** | (2006.01) |
| ***H01R 4/2406*** | (2018.01) |

(52) U.S. Cl.
CPC ..... *H01R 13/5812* (2013.01); *H01R 4/2407* (2018.01); *H01R 13/506* (2013.01); *H01R 4/2406* (2018.01)

(58) Field of Classification Search
CPC .... H01R 9/031; H01R 4/2408; H01R 4/2407; H01R 13/506; H01R 13/5812
See application file for complete search history.

(56) References Cited

U.S. PATENT DOCUMENTS 2,758,280 A * 8/1956 More ..... H01R 4/2408 333/136
4,648,675 A * 3/1987 Gaines ..... F21V 21/0824 439/411
5,601,448 A * 2/1997 Poon ..... F21V 21/0824 439/417
7,063,556 B1 * 6/2006 Wong ..... H01R 4/2408 439/417
7,635,279 B1 * 12/2009 Wong ..... H01R 4/4836 439/419
8,101,874 B2 * 1/2012 Yang ..... H02G 3/088 439/921
8,616,905 B2 * 12/2013 McGregor ..... H01R 12/616 439/207
2010/0093206 A1 * 4/2010 Chuen ..... H01R 4/2408 439/391

FOREIGN PATENT DOCUMENTS

GB 2333909 A * 8/1999 ..... H01R 12/675

* cited by examiner

*Primary Examiner* — Briggitte R. Hammond
(74) *Attorney, Agent, or Firm* — The Law Office Of Austin Bonderer, PC; Austin Bonderer

(57) ABSTRACT

A novel cable connector comprises a main body, a clamp, a conductor assembly, and a controller. The main body is provided with an installation cavity and a receiving slot, and both sides of the receiving slot extend longitudinally to form a left and right wing. The clamp is arranged in the receiving slot, the receiving slot forming a passage for accommodating a cable. The conductor assembly is arranged on the installation cavity of the main body, and comprises a sharp lower end, which protrudes from the top surface of the receiving slot and is located in the passage. The clamp is located between the controller and the main body, the controller cooperates with the left wing and the right wing under an external force to directly apply a force to the clamp to drive the clamp to move towards the top surface of the receiving slot.

12 Claims, 15 Drawing Sheets

CONNECTION TERMINAL

TECHNICAL FIELD

The present application relates to the technical field of power connection, and in particular to a novel cable connector.

BACKGROUND

A cable connector is mainly used to obtain power from the cable at a required position to supply power to the electrical appliance. Generally, the connector pierces a pair of sharp pins into the inner core of the cable in a tightening manner to obtain power and supply it to an external electrical appliance.

However, an example of the existing cable connector of this type is the cable connector described in Chinese patent application No. CN1787288A, which discloses a body having a first sidewall, the first sidewall comprising a passage which opens to the exterior on the same side such that the cable can be laterally inserted into the passage from that side; a clamp in the passage for clamping the cable in the passage; an operator on a second side of the body different from the first side for operating the clamp through a screw action; and a pair of conductors, each having a sharp first end for piercing into the cable clamped in the passage to make contact with a respective conductive core thereof and a second end for external electrical connection. Obviously, this kind of cable connector has many limitations in terms of structure and assembly use. Its components are numerous and complicated, it is inconvenient to use, and connection or disassembly is very troublesome, affecting daily use and maintenance.

It should be mentioned that the information disclosed in the background section is only intended to improve understanding of the general background of the present application and should not be regarded as an acknowledgment or in any form implying that the information constitutes prior art known to one of ordinary skill in the art.

SUMMARY

In view of this, the purpose of the present application is to provide a novel cable connector to solve the above-mentioned problems.

The present application adopts the following technical solutions.

The present application provides a novel cable connector comprising: a main body provided with an installation cavity and a receiving slot, both sides of the receiving slot extending longitudinally to form a left wing and a right wing; a clamp arranged in the receiving slot, the receiving slot forming a passage for accommodating a cable; a conductor assembly arranged on the installation cavity of the main body and comprising a sharp lower end which protrudes from a top surface of the receiving slot and is located in the passage; and a controller, the clamp being located between the controller and the main body, the controller cooperating with the left wing and the right wing under an external force to directly apply a force to the clamp to drive the clamp to move towards the top surface of the receiving slot so that the cable located in the passage is pierced by the lower end of the conductor assembly to form an electrical connection with the conductor assembly.

Preferably, the controller cooperates with the left wing and the right wing through a threaded structure to apply a force to the clamp to drive the clamp to move towards the top surface of the receiving slot.

Preferably, a left side and a right side of the main body each is provided with a guide part for guiding the cable into the passage, and the guide part extending along a direction of the receiving slot and protruding from an outer periphery of the main body.

Preferably, guide openings are formed by opposite ends of the clamp and the corresponding guide parts of the main body for insertion of the cable into the passage.

Preferably, the controller is provided with a driving face, the driving face applying a force to the opposite ends of the clamp to drive the clamp to move towards the top surface of the receiving slot.

Preferably, the receiving slot is provided with a limit step, and the clamp is provided with a convex part that cooperates with the limit step.

Preferably, the clamp is provided with a through groove, a sidewall of the groove being provided with protruding ribs.

Preferably, an upper edge side of the groove is provided with a limit block that engages with the main body, and the main body is correspondingly provided with guide grooves cooperating with the limit block and at least arranged at two sides of the groove; wherein a lower edge side of the groove is provided with a longitudinally extending elastic sidearm having a hook, the elastic sidearm is adapted to open space formed by the left wing and the right wing along a circumferential direction, and the controller is provided with a step part engaging with the hook to limit detachment of the clamp.

Preferably, the left wing and the right wing each are provided with a mating part that keeps the clamp stable when the clamp is moving, and the clamp is provided with a sliding part that matches the mating part.

Preferably, the mating part is an arc-shaped surface, and the sliding part is an arc-shaped ring adapted to the arc-shaped surface.

Preferably, the arc-shaped ring is provided with a reinforcing strip cooperating with the arc-shaped surface, and the reinforcing strip extends along an extending direction of the left wing.

Preferably, the conductor assembly further comprises an upper-end portion, through which the conductor assembly is electrically connected to an external wire. The conductor assembly comprises a vertical support member and an elastic member bent and arranged at one side of the vertical support member. A top portion of the vertical support member is configured as a clamping head, and a bottom portion of the vertical support member is the sharp lower end. The lower end has at least two sharpened heads, which are integrally formed on the vertical support member and arranged alternately back and forth along a length direction of the cable, and at least partially vertically extends into the passage.

Other features of the present application are apparent according to the description of the exemplary embodiments in conjunction with the drawings below.

BRIEF DESCRIPTION OF THE DRAWINGS

In order to explain the technical solutions of the embodiments of the present application more clearly, the following will briefly introduce the drawings used in the embodiments. It should be understood that the following drawings only show certain embodiments of the present application, and therefore should not be regarded as a limitation of the scope.

For those of ordinary skill in the art, other related drawings can be obtained based on these drawings without an inventive step.

DETAILED DESCRIPTION OF EMBODIMENTS

Figure 1:
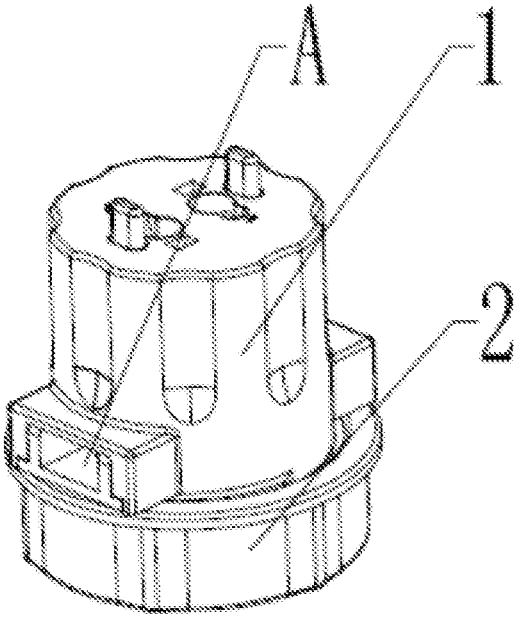
FIG. 1 is a schematic view of a novel cable connector according to an embodiment of the present application.
Figure 2:
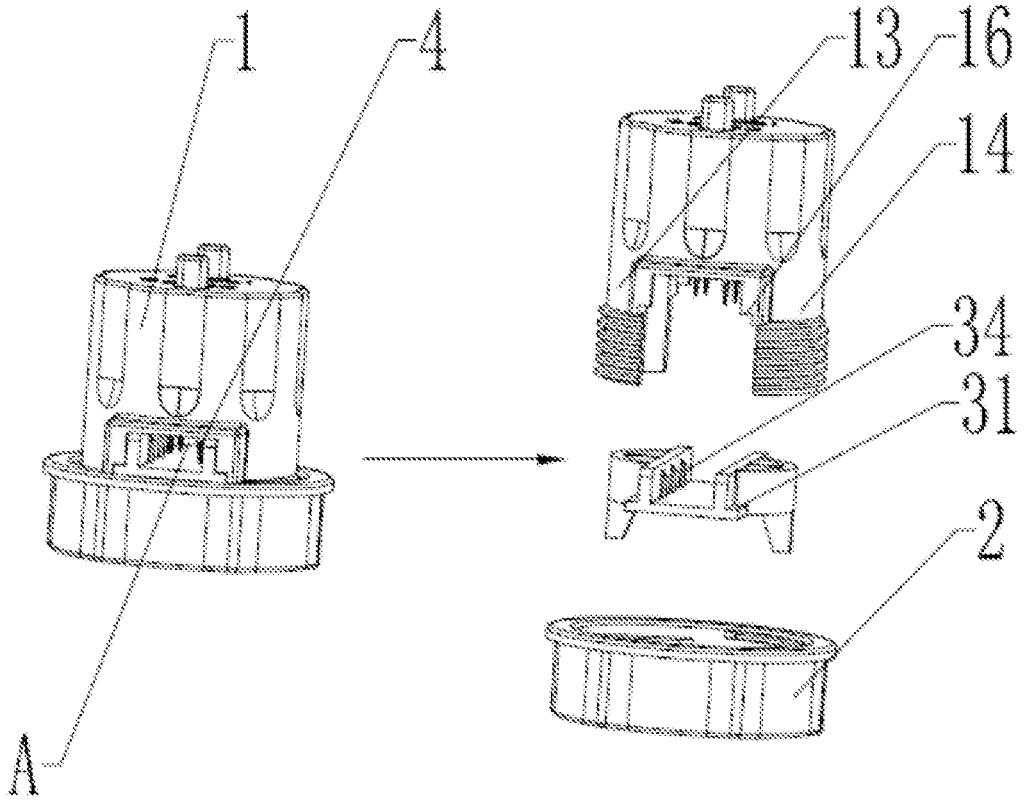
FIG. 2 is a schematic view of a novel cable connector according to an embodiment of the present application from another perspective, wherein the right figure is a schematic view in a partially disassembled state.
Figure 3:
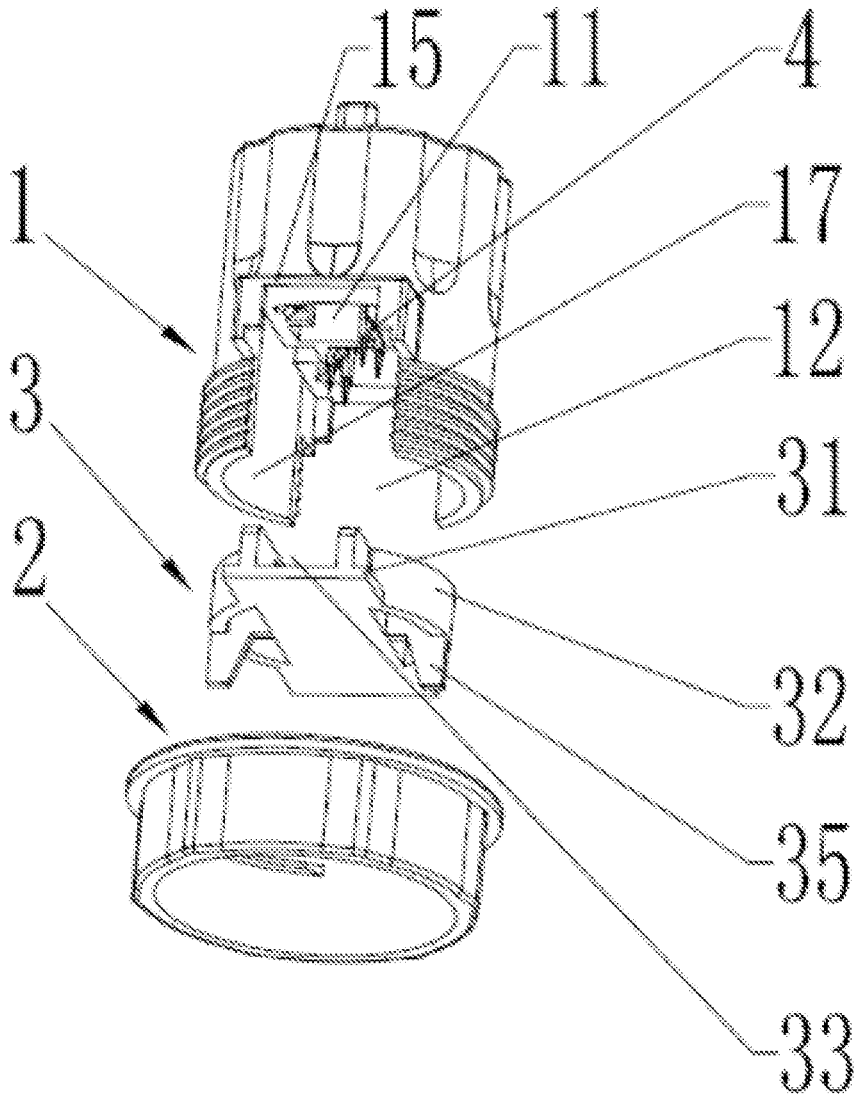
FIG. 3 is a schematic view of disassembly from another perspective of FIG. 2.
Figure 4:
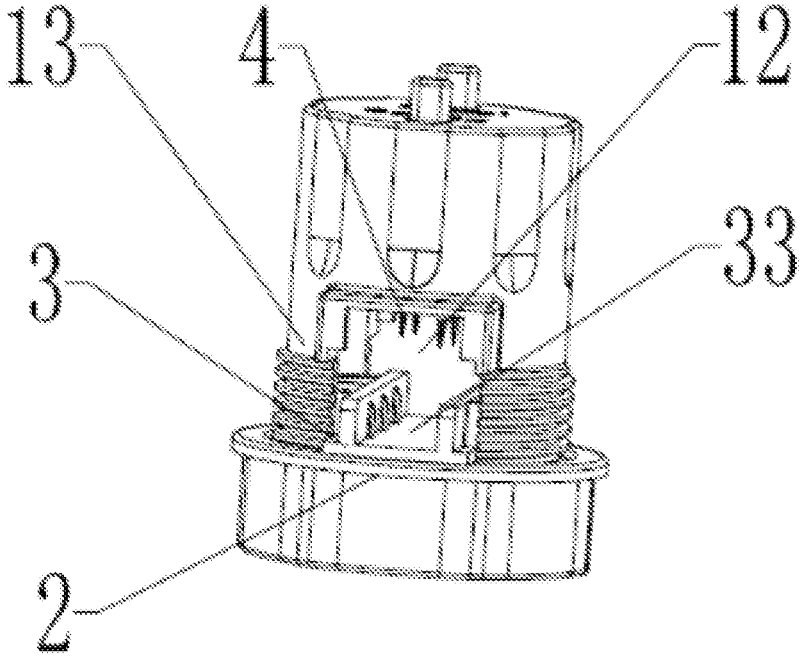
FIG. 4 is a schematic view of a novel cable connector of an embodiment of the present application when the left wing and the right wing are engaged with the controller.

With reference to FIGS. 1 to 8, this embodiment provides a novel cable connector, which comprises: a main body 1, a clamp 3, a conductor assembly 4, and a controller 2. The main body 1 is provided with an installation cavity 11 and a receiving slot 12, and both sides of the receiving slot 12 extend longitudinally to form a left wing 13 and a right wing 14. The clamp 3 is arranged in the receiving slot 12 and forms a passage for accommodating a cable with the receiving slot 12. The conductor assembly 4 is arranged on the installation cavity 11 of the main body 1 and comprises a sharp lower end that protrudes from the top surface of the receiving slot 12 and is located in the passage. The clamp 3 is located between the controller 2 and the main body 1. The controller 2 cooperates with the left wing 13 and the right wing 14 under an external force to directly apply a force to the clamp 3 to drive the clamp 3 to move towards the top surface of the receiving slot 12, so that the cable located in the passage is pierced by the lower end to form an electrical connection with the conductor assembly 4.

In the above embodiment, the installation cavity 11 of the main body 1 is provided with a conductor assembly 4, and the sharp lower end of the conductor assembly 4 protrudes from the bottom surface of the receiving slot 12 and protrudingly arranged in the passage. When the cable is directly supported and placed on the top surface of the clamp 3, the clamp 3 is set on the receiving slot 12 and is located between the main body 1 and the controller 2, and operates on the controller 2 under an external force, so that the controller 2 cooperates with the left wing 13 and the right wing 14 to directly apply a force to the clamp 3. In this way, the clamp 3 is driven to move relative to the top surface of the receiving slot 12 until the cable is pierced by the lower end, and the electrical connection between the cable and the conductor assembly 4 is realized.

In addition, during the tightening and piercing process, the main body 1 and the conductor assembly 4 are always kept in a relatively static state. By operating the controller 2 below, the cable located on the clamp 3 is directly tightened in the passage to be pierced by the lower end. The passive piercing (the cable moves and the lower end does not move) makes the cooperation between the cable and the conductor assembly 4 tighter and more efficient, and the user has better control during use. In addition, the receiving slot 12 of the main body 1 and the clamp 3 form the passage for clamping the cable after the controller 2 is screwed in place, and simplify the components of the connector, which is significant in terms of manufacturing, use, and maintenance.

Conventionally, the assembly process is usually achieved by holes passing through the clamp/housing through the use of a holder, which increases the difficulty of assembly regardless of whether it is automated or manual assembly, resulting in low production efficiency. However, in the cable connector of the present application, through the direct cooperation between the two wings and the controller 2, the clamp 3 can be quickly embedded and assembled into the receiving slot 12, and the number of components can be reduced compared to the existing technology, and the assembly difficulty can be reduced through structural innovation, thereby greatly improving productivity.

In an embodiment, the controller 2 cooperates with the left wing 13 and the right wing 14 to apply a force to the clamp 3 through a threaded structure to drive the clamp 3 to move towards the top surface of the receiving slot 12. Among them, an open space is formed along the circumferential direction between the left wing 13 and the right wing 14, and the clamp 3 is arranged in conformity to the area enclosed by the two wings to allow the clamp 3 to move in the open space relative to the main body 1. Therefore, the two wings form a U-shaped structure at the bottom of the main body 1, and the main body 1 is a hollowed open space along the direction of the passage, so as to facilitate the upward and downward movements of the clamp 3 between the left wing 13 and the right wing 14 without interference.

It should be noted that the outer peripheries of the left wing 13 and the right wing 14 are configured with external threads, and the controller 2 is configured as a knob housing with internal threads, which comprise a single oblique thread with a cut opening. The external thread enters along the cut opening to realize the interlocking and screw connection of the external thread and the internal thread, and the engagement between the main body 1 and the controller 2 is realized by turning the knob shell until they are relatively tightened to ensure the piercing in place. For the detachment of the components, the knob housing is operated in a direction opposite to the tightening direction so that the main body 1 and the controller 2 and the clamp 3 are disassembled into separate pieces along the operation direction.

In addition, the controller 2 is provided with a driving face, and the driving face applies force to the opposite ends of the clamp 3 to drive the clamp 3 to move towards the top surface of the receiving slot 12. A part of the upper-end surface of the knob housing is configured as the driving face, and the clamp 3 is supported and placed at the upper-end surface by the two ends thereof, thereby directly lifting and driving the clamp 3 to move in the accommodating cavity.

In an embodiment, the left side and right side of the main body 1 are provided with guide parts 15 for guiding the cable into the passage, and the guide parts 15 extend in the direction of the receiving slot 12 and protrude from the outer periphery of the main body 1. Specifically, the opposite ends of the clamp 3 and the corresponding guide part 15 of the main body 1 form a guide opening A for inserting the cable into the passage. In particular, both the clamp 3 and the main body 1 extend transversely outwardly at the upper and lower positions of the open space and form the guide opening A of the passage after being assembled. The guide opening A penetrates the passage, which facilitates the placement and insertion of cables and external wires. In addition, the part extending outside the two main bodies 1 lengthens the passage in the horizontal direction to achieve the clamping and fixing as well as guiding and positioning of the cable by the passage. In addition, guide openings A for entry/exit may be provided on both sides of the main body 1 along the transverse direction so as to penetrate throughout the entire passage.

It should be mentioned that the receiving slot 12 is provided with a limit step 16, and the clamp 3 is provided with a convex portion that cooperates with the limit step 16. By the protrusions 31 extending and disposed at both ends of the clamp 3, on the one hand, the supporting arrangement between the driving face and the clamp 3 is facilitated. On the other hand, abutment between the protrusions 31 and the limit step 16 contributes to the tightening and engagement between the controller 2 and the main body 1, which can be used to determine whether the assembly is in place.

Furthermore, the left wing 13 and the right wing 14 are both provided with a mating part 17 that keeps the clamp 3 stable when moving, and the clamp 3 is provided with a sliding part 32 matching the mating part 17. Specifically, the mating part 17 is an arc-shaped surface, and the sliding part 32 is an arc-shaped ring adapted to the arc-shaped surface. In this embodiment, the clamp 3 is provided with a through groove 33, and a raised rib 34 is provided on the side wall of the groove 33. Specifically, the clamp 3 is in the form of a platform, and the upper-end surface of the clamp 3 is provided with a substantially C-shaped groove 33 forming part of the passage. The C-shaped groove 33 faces upwards and penetrates outwards for accommodating a cable, and a raised rib 34 structure capable of supporting and positioning the cable in the lateral direction is provided on a side of the groove 33 wall. The arc-shaped ring of the platform corresponding to the profiling part of the two wings is smaller than the size of the arc-shaped surface formed by the two wings to ensure that the clamp 3 can be fitted and accommodated in the mating part 17 through the sliding part 32. In addition, the C-shaped groove 33 is transversely arranged on the horizontal end surface and extends along its length to partially penetrate the open space, and the extended part can pass between the two wings to form a guiding positioning so that the clamp 3 is configured to slide up and down relative to the main body 1 in a stable posture. In addition, in order to ensure the positioning and stable fixing of the cable on the clamp 3 during the tightening and piercing process, the raised ribs 34 protrudingly provided on the groove 33 walls on both sides of the C-shaped groove 33 can further limit running of the cable, so that the cable is stably placed in the groove 33.

In particular, the arc-shaped ring is provided with reinforcing strips 35 that cooperates with the arc-shaped surface, and the reinforcing strips 35 are formed by extending along the extending direction of the left wing 13. Further, the reinforcing strips 35 extend along the bottom of the clamp 3 and are configured as two supporting feet so that the supporting feet and the sliding part 32 form an integrated guide structure that facilitates stable sliding and fitting on the mating part 17. The guide structure can effectively contact the curved surface, so as to achieve the stable lifting of the clamp 3 in the receiving slot 12. Moreover, such a configuration makes the structure of the clamp 3 in the form of a platform stronger and more stable.

Figure 5:
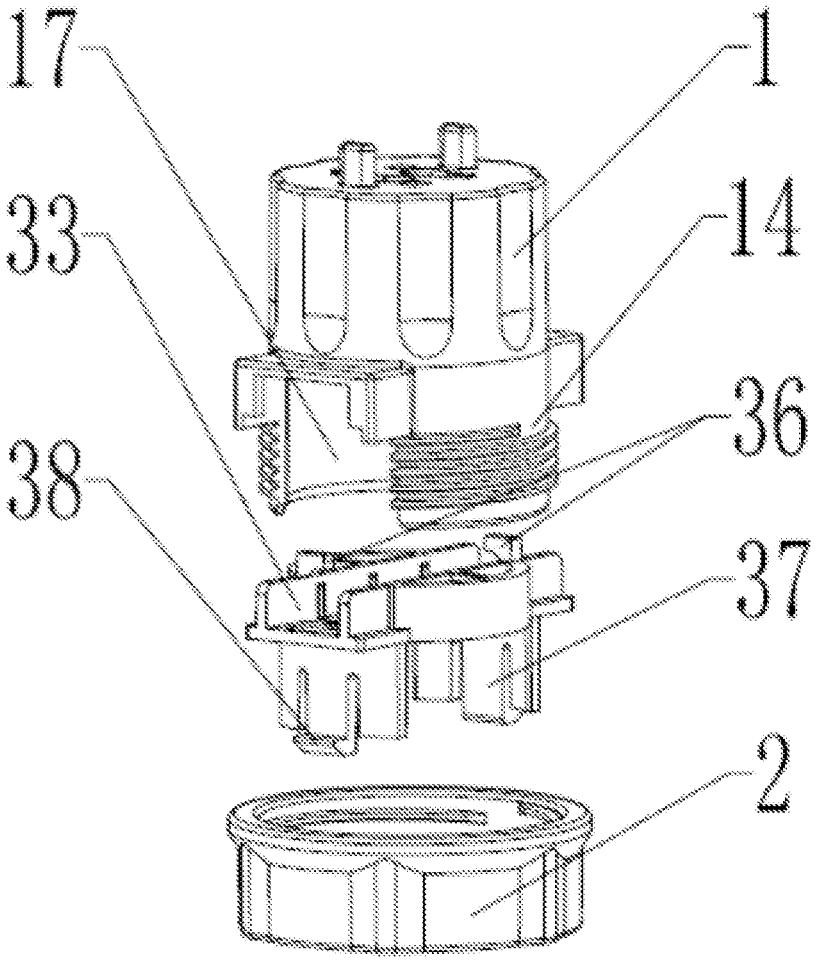
FIG. 5 is a schematic view of a novel cable connector according to another embodiment of the present application in a disassembled state.
Figure 6:
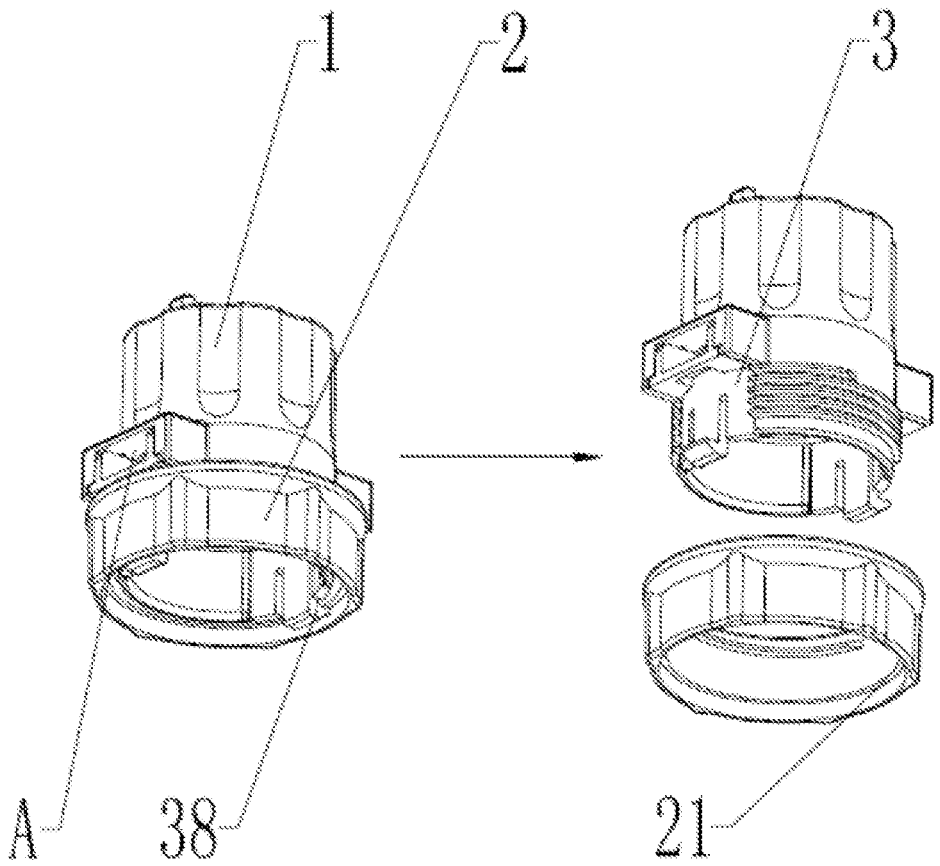
FIG. 6 is a schematic view of a novel cable connector according to another embodiment of the present application, wherein the right figure is a schematic view in a partially disassembled state.
Figure 7:
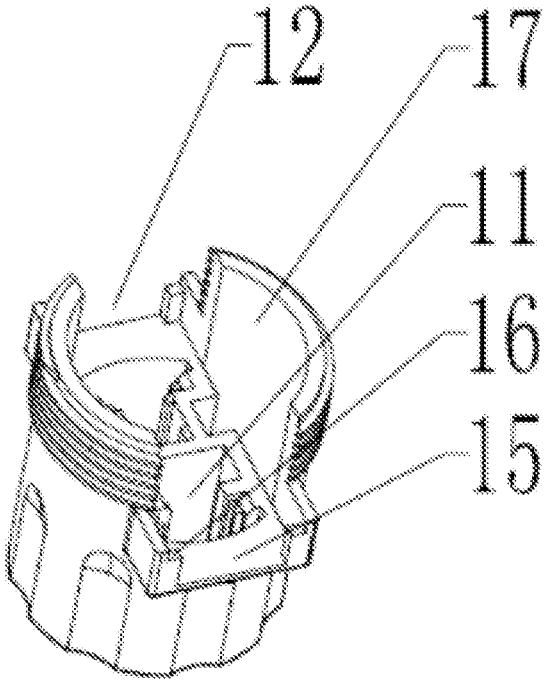
FIG. 7 is a schematic structural view of the main body of the novel cable connector according to an embodiment of the present application.
Figure 8:
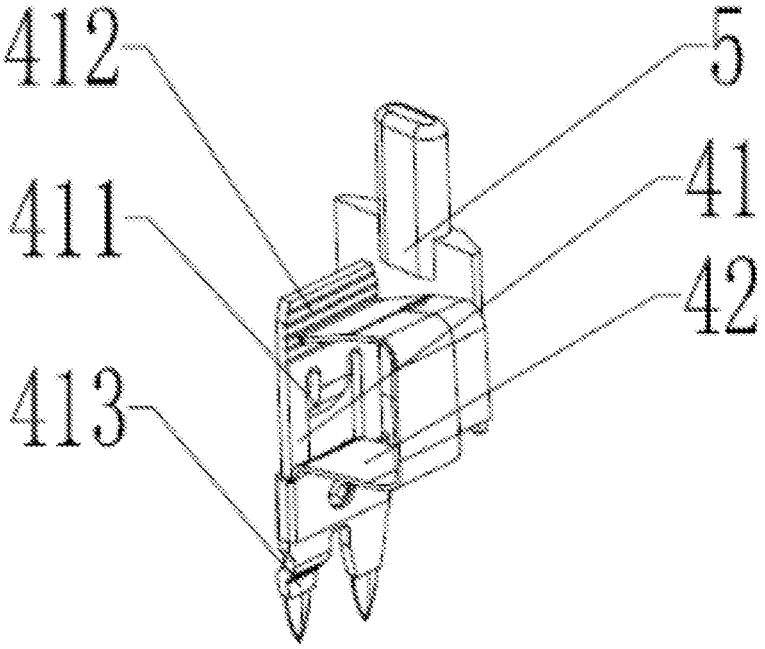
FIG. 8 is a schematic view of a conductor assembly and a release member of a novel cable connector according to an embodiment of the present application.
Figure 9:
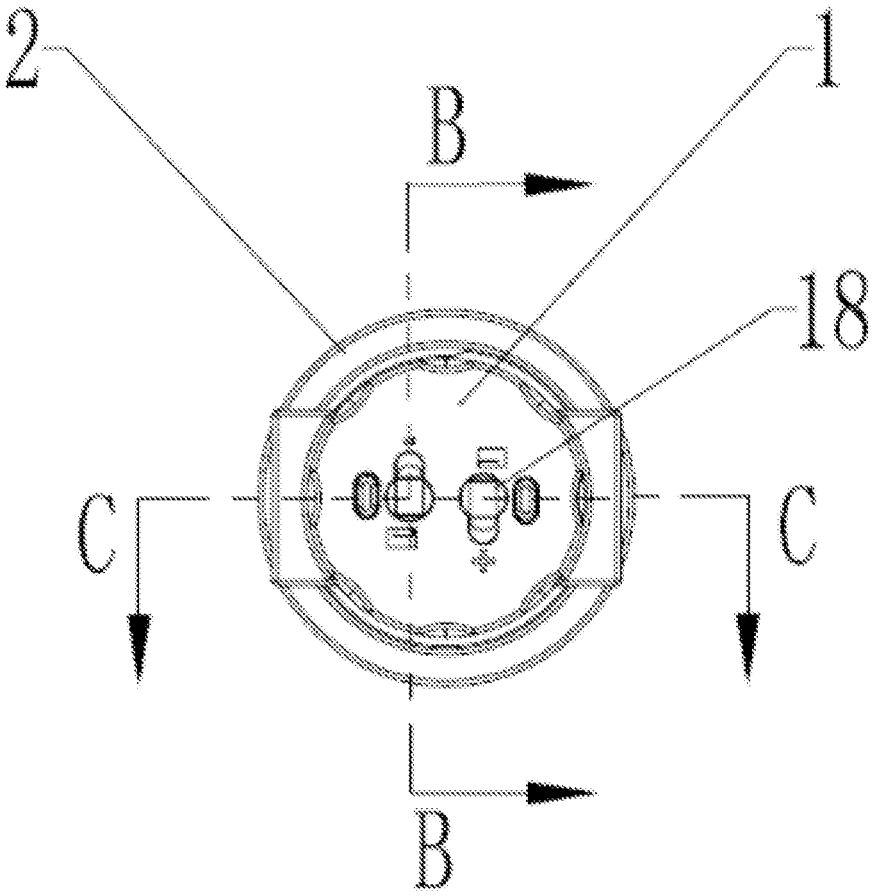
FIG. 9 is a schematic view of the novel cable connector of the embodiment of the present application from another perspective.
Figure 10:
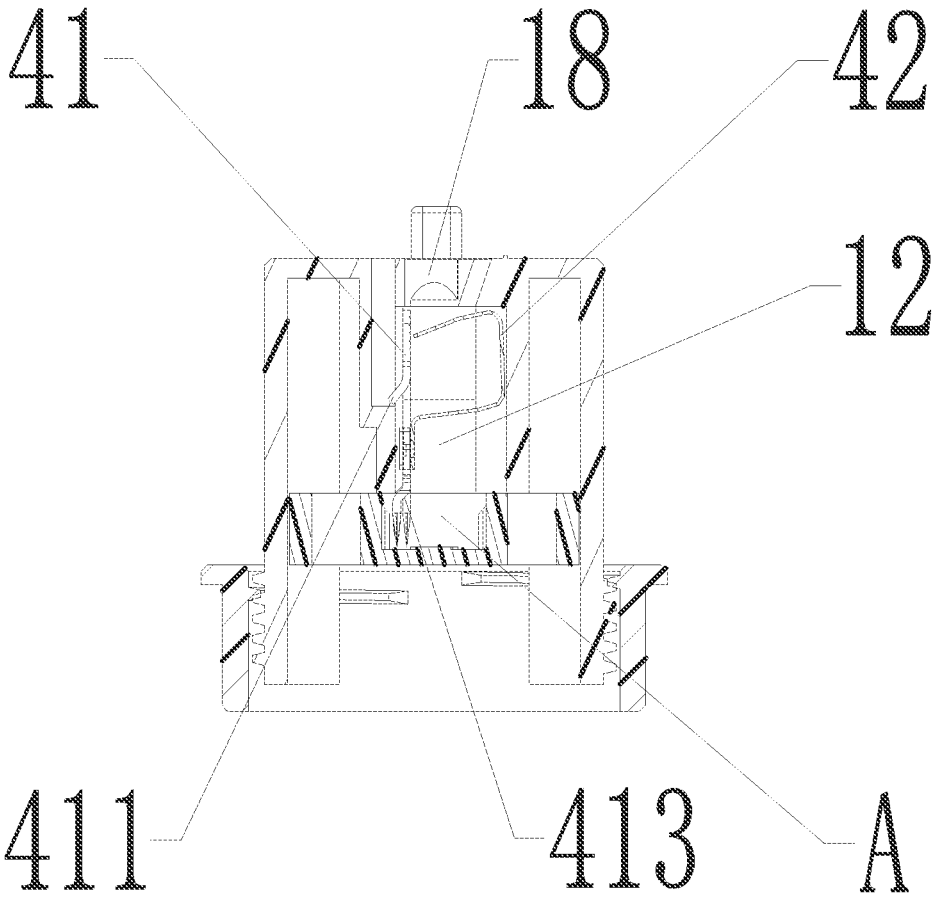
FIG. 10 is a cross-sectional view taken along line B-B in FIG. 9, wherein the main body and the controller are in a tightened state.
Figure 11:
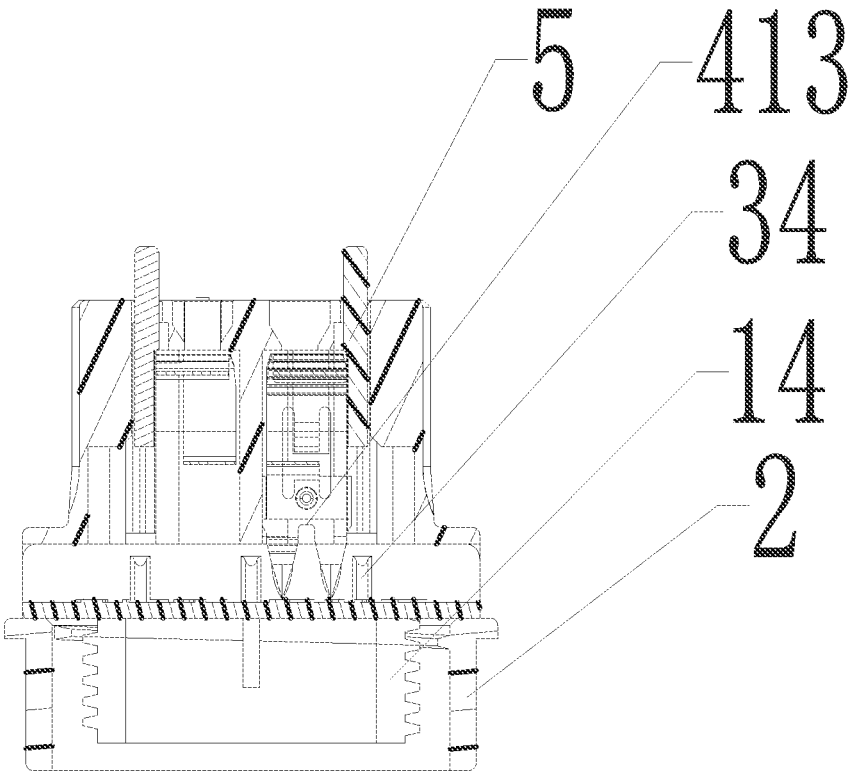
FIG. 11 is a cross-sectional view taken along line C-C in FIG. 9.

Referring to FIGS. 5 and 6, in another embodiment, the upper edge of the groove 33 is provided with limiting blocks 36 that engage with the main body 1, and the main body 1 is provided with corresponding guide grooves mating with the limiting blocks 36, and the limiting blocks 36 are at least arranged on different sides of the groove 33. The lower side of the groove 33 is longitudinally extended with an elastic side arm 37 with a hook 38. The elastic side arm 37 is adapted to the open space formed by the left wing 13 and the right wing 14 in the circumferential direction, and the controller 2 is provided with a step part 21, which is engaged with the hook 38 to limit the detachment of the clamp 3. Specifically, when the cable connector is in use, the clamp 3 is placed between the main body 1 and the controller 2 and is quickly positioned initially through the elastic side arm 37 and the two wings of the main body 1. The elastic side arm 37 is always squeezed elastically with the inner wall of the controller 2 to enhance its stability during the screwing process. When screwed in place, the hook 38 moves to the step part 21; thereby releasing the elastic tightening of the hook 38 in the controller 2 and resetting the hook 38 to hook the step part 21; and thus restricting both from disengaging from each other longitudinally. At the same time, the limiting block 36 is moved into the sliding groove 33 relatively to achieve the accurate positioning of the clamp 3 in its working position.

It should be noted that detachment between the clamp 3 and the controller 2 can be realized by applying an external force or by rotating the hook 38 to an escape opening provided at the step part 21 to come out in the longitudinal direction.

In one embodiment, the conductor assembly 4 at least realizes the electrical connection with the cable in the passage. Power supply for the external electrical appliance (not shown) from the cable can be achieved through an electrical connection between the external electrical appliance and the conductor assembly 4. In this embodiment, electrical contact between the conductor assembly 4 and another cable or wire connected to an external electrical appliance is achieved in a piercing manner. In particular, said another cable might be directly inserted in the passage and contact with the lower end of the same conductor assembly 4 in a piercing manner. Alternatively, the conductor assembly 4 is electrically connected to another wire or cable in a clamping manner. As to this method, please refer to the wire clamping head structure at the upper end of the conductor assembly 4 in the following embodiments.

The above-mentioned cable or wire usually comprises a pair of conductive inner cores protected by an insulating sheath. When tightening and piercing, the sharp lower end of the conductor assembly 4 first pierces the insulating sheath and then directly contacts the inner cores to achieve electrical connection.

Referring to FIGS. 8 to 11. In an embodiment, the conductor assembly 4 is electrically connected to another cable in a clamping manner. Specifically, the upper end of the conductor assembly 4 is used to connect with an external wire or another cable. The conductor assembly 4 further comprises a vertical support member 41 and an elastic member 42 bent and arranged at one side of the vertical support member 41. The top of the vertical support member 41 is configured as a clamping head, and the clamping head is constructed by an elastic member 42 that can be elastically bent. When the elastic member 42 is approaching an end of the cable, the cable end inserted in the clamping head can cause the elastic member 42 to bend inward so that the elastic member 42 and the adjacent vertical support member 41 operate together for subsequent clamping and connection of the cable end. Therefore, the inner core of the other cable is clamped and contacted at an end by the upper end of the conductor assembly 4 via the clamping head. In this configuration, the lower end of the conductor assembly 4 is contacted by the cable accommodated in the passage in a piercing manner, which enables the power supply to the external electrical appliance.

Further, the end of the elastic member 42 away from the clamping head is disposed at the end surface of the vertical support member 41 through a hinge. The elastic member 42 and the vertical support member 41 are a P-shaped leaf-spring structure and elastically abut against the installation cavity 11 in a removable manner. Such a leaf spring structure facilitates the elastic assembly of the conductor assembly 4 in the installation cavity 11. For disassembly of the conductor assembly 4, an elastic sheet structure 411 can be provided at the side of the vertical support member 41 away from the elastic member 42. The elastic sheet structure 411 is controlled by an external tool and then swings to a state of avoiding the installation cavity 11 so that the conductor assembly 4 can be directly removed outside the cavity, which is convenient for replacement and maintenance. The elastic member 42 is relatively arranged on the end face side of the vertical support member 41 in a hinged manner so that the clamping of the wire clamping head is more flexible, and it can adapt to the end insertion of the cable adaptively.

More specifically, one side of the top of the vertical support member 41 facing the clamping head is provided with a regular concave-convex surface 412, and the bottom of the vertical support member 41 is the sharp lower end which comprises at least two sharpened heads 413. The two sharpened heads 413 are integrally formed on the vertical support member 41 and are alternately arranged back and forth along the length of the cable, and the sharpened heads 413 at least partially extend vertically into the passage. In this embodiment, the concave-convex surface 412 is arranged in the clamping area of the clamping head to cooperate with the elastic member 42 to clamp 3 the cable end more tightly, avoiding the situations such as running out of position or contacting improperly. In addition, the concave-convex surface 412 is configured as transverse grooves 33 or raised ribs 34 on the side surface adjacent to the top of the vertical support member 41. In addition, the sharpened heads 413 arranged at the bottom of the vertical support member 41 constitute the sharp lower end of the conductor assembly 4 to realize different ways of contacting and connecting cables in different directions along the longitudinal direction. Further, the two sharpened heads 413 are arranged in a fork-like structure and are alternately arranged, so that the two sharpened heads 413 at the lower end of the conductor assembly 4 are arranged side by side and in different plane positions. As a result, the sharpened heads 413 can thoroughly pierce the same cable, which improves the piercing efficiency and the contact with the inner core of the cable and enhances the reliability of the electrical connection.

It should be noted that the upper-end surface of the main body 1 is provided with a hole slot 18 exposing the clamping head, and the end of an external wire or another cable can enter and connect with the upper end of the conductor assembly 4 through the hole slot 18. The novel cable connector further comprises a release member 5 that can be manually operated. Manually operating the release member 5 makes the elastic member 42 operatively bend inward to open the clamping head and release the end of the cable correspondingly. By pressing the press button of the release member 5, the release member 5 is caused to abut against the elastic member 42 so as to open the clamping head. Moreover, when the user does not press the press button, the release member 5 is elastically biased by the elastic member 42 to its non-operating position. In particular, both the conductor assembly 4 and the release member 5 are arranged in the installation cavity 11.

Please refer to FIGS. 12-15, in an embodiment, the cable connector further comprises a sealing structure. The sealing structure comprises an upper casing 6 that is detachably covered on the main body 1 and a spacer 7 arranged in the installation cavity and located between the receiving slot 12 and the installation cavity. The upper casing 6 and the spacer 7 are assembled on the main body 1 correspondingly to form a closed space inside the main body 1 adapted to the conductor assembly 4.

Figure 13:
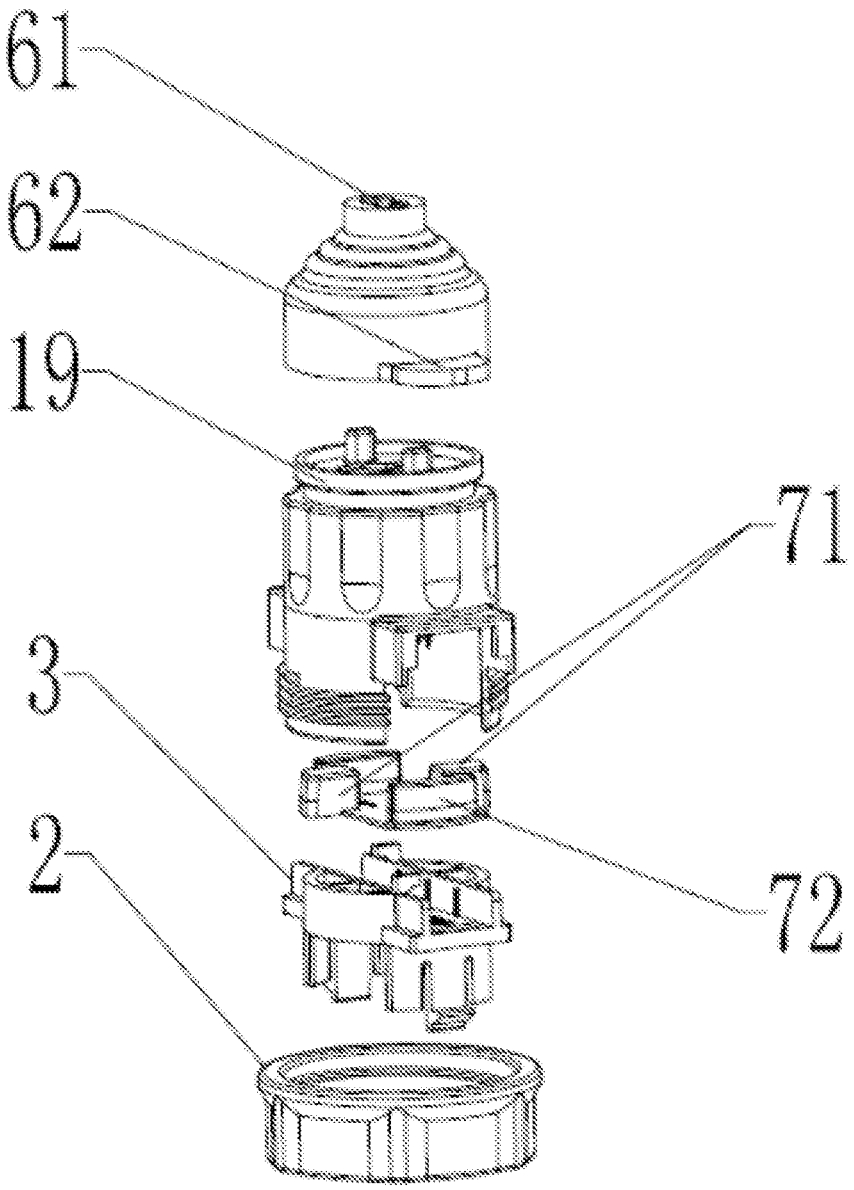
FIG. 13 is a schematic diagram of disassembly of a novel cable connector according to another embodiment of the present application.
Figure 14:
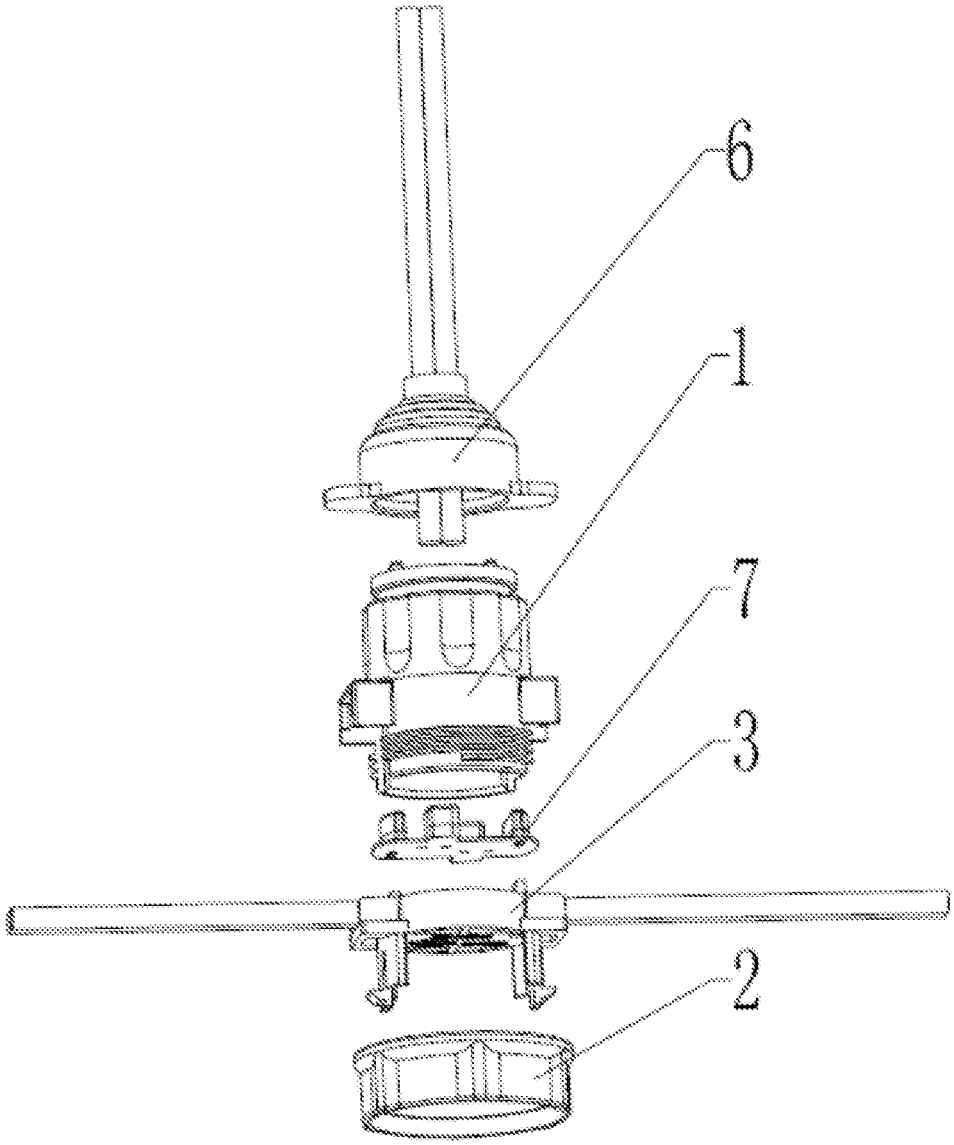
FIG. 14 is a schematic diagram of the application of FIG. 13 from other perspectives.

As shown in FIGS. 13 and 14, specifically, the upper casing 6 can be enclosed at the upper end of the main body and is provided with a wire passage opening 61 for only external wires or cables to enter the main body. Therefore, the wires or cables passing through the wire passage opening 61 can further enter the upper end of the conductor assembly 4 through the hole slot 18 on the upper end surface of the main body 1, to realize multi-mode plug-in connection. In addition, the upper casing 6 and the main body 1 are enclosed and sealed, and only the wire passage opening 61 is reserved to prevent the inside of the main body 1 from being interfered by the external environment, which can achieve remarkable waterproof and dustproof performance. In particular, the upper end surface of the main body 1 is formed with an annular boss 19 that can be elastically fitted with the inner end of the upper casing 6. The upper casing 6 has a pair of operating ears 62 extending laterally for the user to operably implement quick disassembly and assembly.

Figure 15:
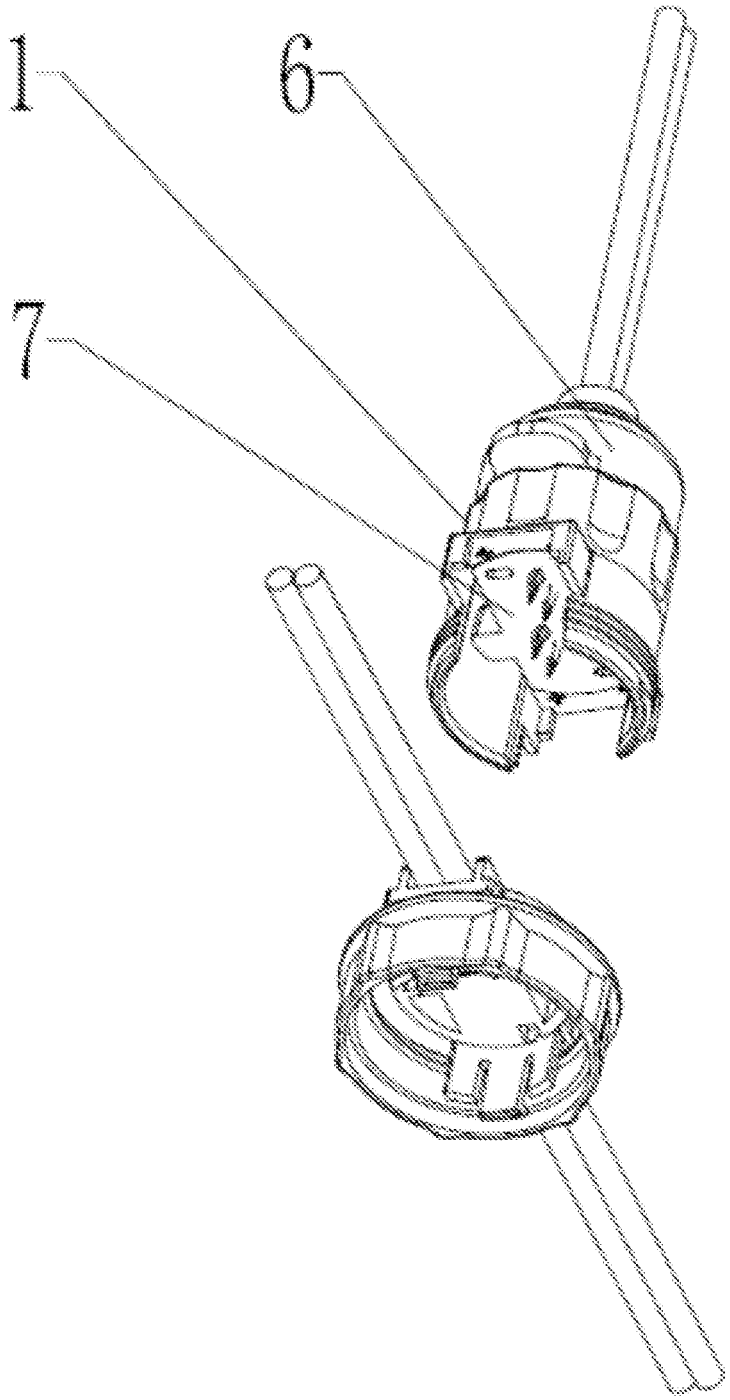
FIG. 15 is a partial disassembly schematic diagram of a novel cable connector according to another embodiment of the present application.

As shown in FIGS. 14 and 15, the spacer 7 is arranged in the installation cavity and sealed between the receiving slot 12 and the installation cavity. The lower end/sharpened head 413 can penetrate through the body of the spacer 7 to be partly contained in the passage. On the one hand, the spacer 7 adjoins the installation cavity and the receiving slot 12 of the main body 1 to independent working areas. On the other hand, the spacer 7 can block the installation cavity along the lower end side of the main body 1, leaving only a piercing space for the sharpened head 413. Therefore, the internal sealing of the main body 1 is further strengthened to improve the entire safety performance of the cable connector.

Figure 12:
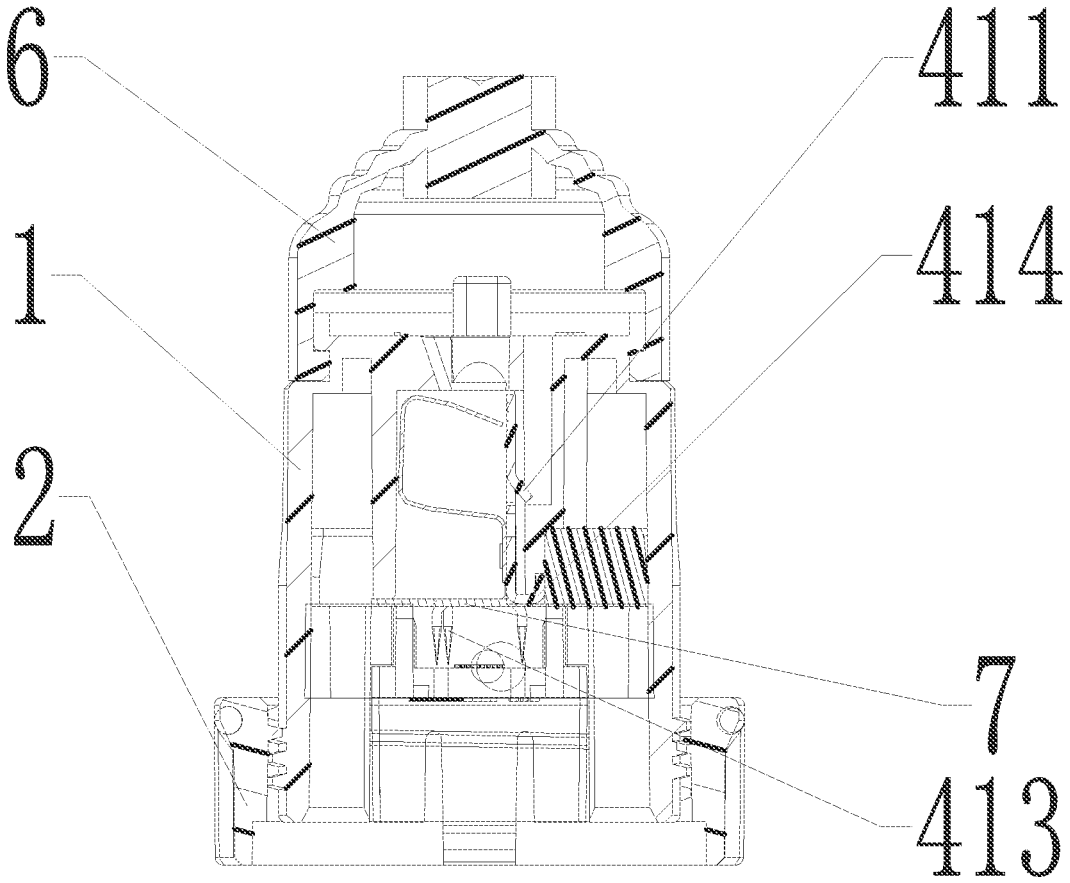
FIG. 12 is A cross-sectional view of a novel cable connector according to another embodiment of the present application.

The spacer 7 is correspondingly provided with a mounting portion for supporting the conductor assembly 4 for elastic support of the conductor assembly 4 in the installation cavity. Specifically, the spacer 7 is provided with engaging portions 71 protruding on both sides of its body, which correspond to the conductor assembly 4. The outer surface of the engaging portion 71 matches the mating part 17 formed by the left/right wing (refers to the arrangement of the sliding part 32 and the mating part 17). The inner surface of the engaging portion 71 forms a mounting portion that can at least partially support the conductor assembly 4. As shown in FIG. 12, in this embodiment, the vertical support member 41 of the conductor assembly 4 is fitted on the mounting portion via a bent sheet structure 414, which is correspondingly disposed under the elastic sheet structure 411. In addition, the spacer 7 is provided with sliding contact parts 72 on the other two sides of the body corresponding to the guide part 15. The sliding contact parts 72 can be guided along the open space formed by the two wings and stably slide in the main body 1.

In particular, the upper casing 6 and the spacer 7 are both configured as a sealing structure made of silicone material, and can be respectively elastically assembled on the main body 1 along the longitudinal direction. Therefore, the space entering the installation cavity can be tightly sealed, which has a significant waterproof effect.

In one embodiment, the passage can accommodate at least two cables side by side. The main body 1 is correspondingly provided with a plurality of installation cavities 11, wherein each installation cavity 11 is provided with a conductor assembly 4 used to pierce and contact a facing cable. Therefore, through the multiple conductor assemblies 4 and the corresponding pierced cables, electricity can be taken from the corresponding cables and supplied to different electrical appliances to realize the power supply. In addition, the number of conductor assemblies 4 is at least the same as the number of cables that can be accommodated to ensure that one cable can be pierced by at least one conductor assembly 4. In this embodiment, the conductor assemblies 4 used to pierce different cables are arranged in a staggered arrangement along the length of the passage.

It should be mentioned that the main body 1, the clamp 3, and the controller 2 are all integrally formed separate pieces, and they are all made of plastic. In addition, the main body 1, the left wing 13 and the right wing 14 are integrally formed and configured to be similar to a cover structure. In this way, the main body 1 provided with the conductor assembly 4 serves as a relatively static holder, and its upper plate is more stable, which greatly facilitates installation and placement of the cable connector. Moreover, the main body 1 located above and the controller 2 located below are further assembled and disassembled in a knob manner, making the operation easier. In particular, the conductor assembly 4 is configured as a copper pin structure.

The above are only the preferred embodiments of the present application, and the protection scope of the present application is not limited to the above-mentioned embodiments. Any other technical solution under the idea of the present application belongs to the protection scope of the present application.

What is claimed is:

1. A cable connector comprising:

a main body provided with an installation cavity and a receiving slot, both sides of the receiving slot extending longitudinally to form a left wing and a right wing;

a clamp arranged in the receiving slot, the receiving slot forming a passage for accommodating a cable;

a conductor assembly arranged on the installation cavity of the main body and comprising a sharp lower end which protrudes from a top surface of the receiving slot and located in the passage; and a controller, the clamp being located between the controller and the main body, the controller cooperating with the left wing and the right wing under an external force to directly apply a force to the clamp to drive the clamp to move towards the top surface of the receiving slot, so that the cable located in the passage is pierced by a conductor assembly lower end to form an electrical connection with the conductor assembly, wherein the receiving slot is provided with a limit step, and the clamp is provided with a convex part that cooperates with the limit step, wherein the clamp is provided with a through groove, a side wall of the groove being provided with protruding ribs, wherein an upper edge side of the groove is provided with a limit block that engages with the main body, and the main body is correspondingly provided with guide grooves cooperating with the limit block and at least arranged at two sides of the groove;

wherein a lower edge side of the groove is provided with a longitudinally extending elastic side arm having a hook, the elastic side arm is adapted to open space formed by the left wing and the right wing along a circumferential direction, and the controller is provided with a step part engaging with the hook to limit detachment of the clamp.

2. The cable connector according to claim 1, wherein the controller cooperates with the left wing and the right wing through a threaded structure to apply a force to the clamp to drive the clamp to move towards the top surface of the receiving slot.

3. The cable connector according to claim 1, wherein a left side and a right side of the main body each is provided with a guide part for guiding the cable into the passage, the guide part extending along a direction of the receiving slot and protruding from an outer periphery of the main body.

4. The cable connector according to claim 3, wherein guide openings are formed by opposite ends of the clamp and corresponding guide parts of the main body for insertion of the cable into the passage.

5. The cable connector according to claim 4, wherein the controller is provided with a driving face, the driving face applying a force to the opposite ends of the clamp to drive the clamp to move towards the top surface of the receiving slot.

6. The cable connector according to claim 1, wherein the left wing and the right wing each is provided with a mating part that keeps the clamp stable when the clamp is moving, and the clamp is provided with a sliding part that matches the mating part.

7. The cable connector according to claim 6, wherein the mating part is an arc-shaped surface, and the sliding part is an arc-shaped ring adapted to the arc-shaped surface.

8. The cable connector according to claim 7, wherein the arc-shaped ring is provided with a reinforcing strip cooperating with the arc-shaped surface, and the reinforcing strip extends along an extending direction of the left wing.

9. The cable connector according to claim 1, wherein the conductor assembly further comprises an upper-end portion, through which the conductor assembly is electrically connected to an external wire;

wherein the conductor assembly comprises a vertical support member and an elastic member bent and arranged at one side of the vertical support member; a top portion of the vertical support member is configured as a clamping head, and a bottom portion of the vertical support member is the sharp lower end having at least two sharpened heads, which are integrally formed on the vertical support member and arranged alternately back and forth along a length direction of the cable, and at least partially vertically extends into the passage.

10. The cable connector according to claim 1, further comprising a sealing structure, the sealing structure comprising a removable cover provided on a main body upper casing and a spacer arranged in the installation cavity and seated between the receiving slot and the installation cavity;

wherein the main body upper casing and the spacer are correspondingly assembled on the main body to form a closed space inside the main body adapted to the conductor assembly.

11. The cable connector according to claim 10, wherein the main body upper casing can be enclosed at an upper end of the main body and is provided with a wire passage opening for only an external wire to enter the main body.

12. The cable connector according to claim 10, wherein the spacer is correspondingly provided with a mounting portion for supporting the conductor assembly, so that the conductor assembly is elastically supported in the installation cavity, and the spacer only allows the conductor assembly lower end to penetrate through its body to be partially contained in the passage.

* * * * *